US007435714B2

(12) United States Patent
Kottke et al.

(10) Patent No.: US 7,435,714 B2
(45) Date of Patent: Oct. 14, 2008

(54) LIQUID DETERGENT AND CLEANING AGENT COMPOSITION COMPRISING A MULTI-COATED BLEACH PARTICLE

(75) Inventors: Ulrike Kottke, Gelnhausen (DE); Silke Stoschek, Flörsbachtal (DE); Klaus Zimmermann, Rodenbach (DE); Ralph Overdick, Hofheim (DE); Michael Fender, Flieden (DE); Harald Jakob, Hasselroth (DE)

(73) Assignee: Evonik Degussa GmbH, Essen (DE)

( * ) Notice: Subject to any disclaimer, the term of this patent is extended or adjusted under 35 U.S.C. 154(b) by 424 days.

(21) Appl. No.: 10/539,285

(22) PCT Filed: Dec. 11, 2003

(86) PCT No.: PCT/EP03/14027

§ 371 (c)(1),
(2), (4) Date: Dec. 16, 2005

(87) PCT Pub. No.: WO2004/056955

PCT Pub. Date: Jul. 8, 2004

(65) Prior Publication Data

US 2006/0148669 A1 Jul. 6, 2006

(30) Foreign Application Priority Data

Dec. 20, 2002 (DE) ..... 102 61 161
Jan. 30, 2003 (DE) ..... 103 03 572

(51) Int. Cl.
*C11D 3/395* (2006.01)

(52) U.S. Cl. ..... 510/349; 510/220; 510/221; 510/232; 510/233; 510/276; 510/296; 510/302; 510/304; 510/309; 510/312; 510/320; 510/338; 510/367; 510/372; 510/371; 510/378; 510/392; 510/407; 510/418; 510/439; 510/441; 510/511

(58) Field of Classification Search ..... 510/220, 510/221, 232, 233, 276, 296, 302, 304, 309, 510/312, 320, 338, 349, 367, 372, 371, 378, 510/392, 407, 418, 439, 441, 511
See application file for complete search history.

(56) References Cited

U.S. PATENT DOCUMENTS

| | | | | |
|---|---|---|---|---|
| 3,830,738 | A | 8/1974 | Cottrell | |
| 3,951,838 | A | 4/1976 | Jayawant et al. | |
| 4,105,827 | A | 8/1978 | Brichard et al. | |
| 4,215,990 | A | 8/1980 | Barrett, Jr. et al. | |
| 4,325,933 | A | 4/1982 | Matsumoto et al. | |
| 4,526,698 | A * | 7/1985 | Kuroda et al. | 510/305 |
| 4,748,488 | A | 5/1988 | Suzuki et al. | |
| 5,122,518 | A | 6/1992 | Vrba et al. | |
| 5,332,518 | A * | 7/1994 | Kuroda et al. | 510/309 |
| 5,374,368 | A | 12/1994 | Hauschild | |
| 5,380,456 | A | 1/1995 | Woods | |
| 5,478,488 | A | 12/1995 | Doetsch et al. | |
| 5,496,542 | A | 3/1996 | Hauschild | |
| 5,505,875 | A | 4/1996 | Beaujean et al. | |
| 5,560,896 | A | 10/1996 | Bewersdorf et al. | |
| 5,674,436 | A | 10/1997 | Breitenbach et al. | |
| 5,695,679 | A | 12/1997 | Christie et al. | |
| 5,785,934 | A | 7/1998 | Jacobs et al. | |
| 5,814,592 | A * | 9/1998 | Kahn et al. | 510/304 |
| 5,902,682 | A * | 5/1999 | Bertsch-Frank et al. | 428/403 |
| 5,906,660 | A | 5/1999 | Pardini et al. | |
| 5,935,708 | A | 8/1999 | Schuette et al. | |
| 5,965,505 | A | 10/1999 | Baillely et al. | |
| 6,017,867 | A | 1/2000 | Baillely | |
| 6,121,502 | A | 9/2000 | Tembe et al. | |
| 6,165,959 | A * | 12/2000 | Meyer et al. | 510/311 |
| 6,194,368 | B1 | 2/2001 | Waschenbach et al. | |
| 6,239,095 | B1 | 5/2001 | Bertsch-Frank et al. | |
| 6,267,934 | B1 | 7/2001 | Pardini et al. | |
| 6,290,775 | B1 | 9/2001 | Kohlen et al. | |
| 6,387,861 | B1 | 5/2002 | Van Asperen et al. | |
| 6,521,583 | B1 | 2/2003 | James et al. | |
| 6,602,837 | B1 | 8/2003 | Patel | |
| 2002/0041843 | A1 | 4/2002 | Jakob et al. | |
| 2003/0160209 | A1 | 8/2003 | Hoffman et al. | |
| 2005/0239681 | A1 | 10/2005 | Speckman | |
| 2006/0014658 | A1 | 1/2006 | Zimmermann et al. | |
| 2006/0249707 | A1 | 11/2006 | Zimmermann et al. | |

FOREIGN PATENT DOCUMENTS

| | | |
|---|---|---|
| AU | B-31754/95 | 4/1996 |

(Continued)

OTHER PUBLICATIONS

International Search Report dated Apr. 6, 2004.

(Continued)

*Primary Examiner*—Charles I Boyer
(74) *Attorney, Agent, or Firm*—Michael A. Sanzo; Law Office of Michael A. Sanzo, LLC

(57) ABSTRACT

The invention relates to liquid detergent and cleaning agent compositions of high storage stability. They comprise a liquid medium with a water content of up to 15 wt. % and particulate coating bleaching agents suspended therein. The bleaching agent has a dissolving time of at least 5 minutes and a coating of at least two layers: The innermost layer comprises one or more hydrate-forming inorganic salts as the main component (s), and an outer layer, which makes up 0.2 to 5 wt. % of the coated bleaching agent, comprises alkali metal silicate(s) with a modulus of SiO2 to M2O (M=alkali metal) of greater than 2.5 as the main component(s). Preferred compositions comprise sodium percarbonate with an innermost layer of substantially sodium sulfate and an outermost layer of substantially 0.5 to 1.5 wt. % sodium silicate (modulus 3.2 to 4.2) as the bleaching agent.

16 Claims, No Drawings

FOREIGN PATENT DOCUMENTS

| | | | |
|---|---|---|---|
| CA | 2 170 599 | | 3/1995 |
| CA | 2326 560 | A1 | 5/2001 |
| CA | 2 511 022 | | 7/2004 |
| DE | 870 092 | | 3/1953 |
| DE | 962 251 | | 4/1957 |
| DE | 2 013 763 | | 10/1971 |
| EP | 0 367 934 | | 5/1990 |
| EP | 0 634 478 | | 1/1995 |
| EP | 634478 | * | 1/1995 |
| EP | 0 672 749 | | 9/1995 |
| EP | 0 703 190 | | 3/1996 |
| EP | 0 722 992 | | 7/1996 |
| EP | 0 737 738 | | 10/1996 |
| EP | 0 623 553 | | 7/1997 |
| EP | 0 962 424 | | 12/1999 |
| EP | 0 970 917 | | 1/2000 |
| EP | 0 992 575 | | 4/2000 |
| EP | 1 386 599 | | 2/2004 |
| GB | 174891 | | 1/1922 |
| GB | 1303810 | | 1/1973 |
| GB | 1466799 | | 3/1977 |
| JP | 06-263-434 | | 9/1994 |
| WO | WO 92/07057 | | 4/1992 |
| WO | WO 95/02555 | | 1/1995 |
| WO | WO 95/02724 | | 1/1995 |
| WO | WO 95/06615 | | 3/1995 |
| WO | WO 96/06801 | | 3/1996 |
| WO | WO 96/14388 | | 5/1996 |
| WO | WO 97/19890 | | 6/1997 |
| WO | WO 97/43211 | | 11/1997 |
| WO | WO 97/45524 | | 12/1997 |
| WO | WO 00/71666 | | 11/2000 |
| WO | WO 01/34759 | | 5/2001 |
| WO | WO 01/66685 | | 9/2001 |
| WO | WO 01/80645 | | 11/2001 |
| WO | WO 02/057402 | | 7/2002 |
| WO | WO 2004/056954 | | 7/2004 |
| WO | WO 2004/056955 | A1 | 7/2004 |

OTHER PUBLICATIONS

Abstract for WO 96/14388, reference B2 above.
Abstract for WO 01/66685, reference B3 above.
English Abstract for WO 95/02555. reference B6 above.
English Abstract for WO 97/43211, reference B7 above.
English language translation for DE 962 251, reference B5 above.
English language abstract for DE 2 013 763, reference B6 above.
English language abstract for EP 0 367 934, reference B7 above.
English language abstract for EP 0 703 190, reference B9 above.
English language abstract for EP 0 722 992, reference B10 above.
English language abstract for EP 0 970 917, reference B12 above.
English language abstract for JP 06-263434, reference B14 above.
English language abstract fo WO 95/06615, reference B17 above.
English language abstract for WO 96/06801, reference B18 above.

* cited by examiner

LIQUID DETERGENT AND CLEANING AGENT COMPOSITION COMPRISING A MULTI-COATED BLEACH PARTICLE

CROSS REFERENCE TO RELATED APPLICATIONS

The present application represents U.S. national stage of international application PCT/EP2003/014027, which had an international filing date of Dec. 11, 2003, and which was published in English under PCT Article 21(2) on Jul. 8, 2004. The international application claims priority to German applications 102 61 161.0, filed on Dec. 20, 2002, and 103 03 572.9, filed on Jan. 30, 2003. These prior applications are hereby incorporated by reference in their entirety.

FIELD OF THE INVENTION

The invention relates to a liquid detergent and cleaning agent composition comprising a liquid medium with a water content of up to 15 wt. % and particulate coated bleaching agents suspended in the liquid medium.

BACKGROUND OF THE INVENTION

Although detergents and cleaning compositions comprising bleaching agents are usually used in powder or granule form, there is an interest in also marketing and using such products in the liquid form.

GB Patent 1 303 810 discloses pourable, liquid compositions for cleaning and rinsing purposes which comprise a clear liquid medium and one or more particulate components suspended therein. The liquid medium, which can be aqueous or non-aqueous, comprises one or more cleaning-active components, such as anionic, nonionic or cationic surfactants directed towards the intended use. The material suspended in the liquid medium expediently comprises those components which produce a specific technical effect in the composition. Examples which are mentioned in this document are bleaching agents, enzymes and perfumes, it being possible for these substances to be surrounded by a coating which serves to avoid an interaction with the liquid medium. A cleaning composition of the generic type comprises a bleaching-active chlorine compound, that is to say a sodium hypochlorite solution, encapsulated in a polyethylene wax. The compositions of the generic type additionally comprise substances to adjust the rheological properties, as a result of which the particulate constituents are kept in a stable suspension in the liquid medium.

GB 1,303,810 A1 gives no indication of whether and in what form sodium percarbonate, which is known to be not very stable in the presence of moisture, and therefore a high loss of active oxygen must be expected during storage in a liquid detergent comprising water, can be incorporated into a liquid detergent and cleaning composition.

WO 01/66685 A1 discloses non-aqueous liquid detergent and cleaning compositions which are characterized by the presence of liquid bleaching activators. "Non-aqueous" is understood as meaning a content of free water of less than 5 wt. %, in particular less than 2 wt. %. The compositions can also comprise dispersed bleaching agents. Sodium perborates, sodium percarbonate, persulfates, peroxypyrophosphates and alkyl and aryl peroxy acids, inter alia, are mentioned. The bleaching agents can also be coated, but no specific coatings are mentioned. The compositions of the examples comprise neither sodium percarbonate nor a coated sodium percarbonate. The problem of the loss of active oxygen due to the water present during storage of such compositions comprising bleaching agents is not referred to.

WO 02/057402 A1 discloses washing- and cleaning-active liquid compositions which comprise a transparent or translucent liquid medium and solid particles, the liquid medium comprising less than 10 wt. % of water and the composition being packaged in ready-for-use portions in bags of a transparent or translucent water-soluble material. The liquid medium comprises, in particular, anionic and/or nonionic surfactants, water-soluble builders and additionally solvents, such as alcohols. The solid particles are, in particular, bleaching agents, bleaching activators and enzymes. Among the bleaching-active components, alkali metal percarbonates, in particular sodium percarbonate, are mentioned. Such substances are expediently used in granule form, and in particular in a coated form, where the coating material can include one or more inorganic salts, such as alkali metal silicates and carbonate and borate salts, or organic materials, such as waxes, oils and soaps.

An essential feature of the compositions according to WO 02/057402 A1 is that both the liquid medium and the bag are transparent or translucent. For reasons of better marketing, it has since been acknowledged that it would be more advantageous if the bag and/or the medium were opaque, since the customer could regard the suspended material as a disadvantage and/or associate it with an undesirable change in quality.

The document acknowledged above contains no example of a detergent which comprises a particulate bleaching agent, such as sodium percarbonate. The document also does not show what criteria a coating of sodium percarbonate must fulfill in order to ensure in a water-containing liquid detergent or cleaning composition on the one hand an adequate storage stability, but on the other hand a good activity during the washing or cleaning process.

It is indeed known from the abovementioned WO specification and other documents that the storage stability of sodium percarbonate in a damp warm environment can be improved by application of a single- or multilayered coating, one coating material also being an alkali metal silicate, but the products known to date have proved to be unsuitable for use in liquid detergent and cleaning compositions in one or other aspect, in particular in respect of their storage stability and release of the bleaching agent in a manner appropriate for the use.

It is indeed known that by application of a coating layer of substantially alkali metal silicate to sodium percarbonate particles the release of the sodium percarbonate in an aqueous environment can be delayed, but large amounts of coating are necessary for an adequate delay, which in their turn adversely impair the washing activity, since the alkali metal silicate is not dissolved satisfactorily in the wash liquor and the "coatings" can therefore be deposited on the laundry as grey tinge. Such undissolved constituents can also lead to undesirable deposits in the washing machine.

The doctrine of EP 0 623 553 A1 is that the dissolving time of sodium percarbonate which has a coating layer of 1.5 wt. % sodium silicate is 3.5 minutes. An increase in the coating layer to 12.5 wt. % indeed leads to a prolonging of the dissolving time to about 9 minutes, but a sodium percarbonate coated in this way proved to be unsuitable in a liquid detergent with about 5 wt. % water, because too high a loss of active oxygen occurred during storage. According to EP 0 992 575 A1 the dissolving time of sodium percarbonate can indeed be increased further by using an alkali metal silicate with a modulus of greater than 3 to 5 for the coating and employing it in a correspondingly high amount, but the products obtained in this way lead to the grey tinge already mentioned.

DESCRIPTION OF THE INVENTION

The object of the present invention accordingly is to provide a liquid detergent and cleaning agent composition which comprises a liquid medium with a water content of up to 15 wt. %, in particular 3 to 10 wt. %, based on the composition, and one or more particulate coated bleaching agents suspended in the liquid medium, in particular coated sodium percarbonate, which has an adequate storage stability with a simultaneously high bleaching activity.

According to a further object of the invention, the particulate coated bleaching agents contained in the composition, such as, in particular, coated sodium percarbonate, should have such a coating which leads to no grey tinge during use as a detergent.

According to a further object of the invention, such compositions should be provided which additionally comprise, in addition to a particulate coated bleaching agent based on an inorganic peroxy compound, activators which also display their action in full after a relatively long storage time and dissolve the peroxy compound and the activator at about the same speed during the washing or cleaning process and are therefore capable of the formation of a peroxycarboxylic acid.

According to further objects, such compositions in which it cannot be seen visually that they comprise a suspended material should be provided.

The abovementioned objects and further objects such as are deduced from the following description are achieved by the compositions according to the invention.

A liquid detergent and cleaning agent composition comprising a liquid medium with a water content of up to 15 wt. %, based on the composition, and one or more particulate coated bleaching agents, suspended in the liquid medium, from the series consisting of inorganic and organic peroxy compounds has been found, characterized in that the bleaching agent has a coating of at least two layers, wherein an innermost layer, which makes up 2 to 20 wt. % of the coated bleaching agent, comprises one or more hydrate-forming inorganic salts as the main component(s), and an outer layer, which makes up 0.2 to 5 wt. %, in particular 0.2 to less than 3 wt. % of the coated bleaching agent, comprises alkali metal silicate(s) with a modulus of $SiO_2$ to $M_2O$ (M=alkali metal) of greater than 2.5 as the main component(s), and wherein the coated bleaching agent has a dissolving time of at least 5 minutes (measured for 95% dissolution in water at 15° C. and 2 g/l).

The composition conventionally comprises at least such an amount of water as is present as a secondary constituent in the starting substances, that is to say at least about 0.5 wt. %. The water can be in the free form and/or a weakly bonded form. The amount stated is that which can be detected by means of Karl Fischer titration.

The subclaims relate to preferred embodiments of the composition, particularly preferred compositions comprising a sodium percarbonate coated according to the invention as the bleaching agent. Finally, a further subclaim relates to a composition of the generic type, which is packaged in portioned form in bags of a water-soluble polymeric material which are suitable for washing and cleaning purposes.

It has been found that liquid detergent and cleaning agent compositions according to the invention with a two-layered coating, according to the claims, on the particulate bleaching agent both have the storage stability desired in practice and also substantially avoid the problem of greying of the laundry because of the specific choice and embodiment of the coating. Surprisingly, it is even possible to use in the detergent and cleaning agent compositions according to the invention such coated bleaching agents in which the total amount of coating makes up less than 10 wt. %, based on the coated bleaching agent.

It has been found that the dissolving time of the coated bleaching agent in water—95% dissolution at 15° C. at a use concentration of 2 g/1—is an important choice criterion for the suitability of a coated bleaching agent for liquid detergent and cleaning compositions. The dissolving time is expediently more than 5 minutes, in particular more than 10 minutes and in particular in the range from 15 to 30 minutes. However, the dissolving time is not the only choice criterion, but the residual active oxygen content in a water-containing detergent test recipe after an appropriate storage time must additionally be determined. The residual active oxygen content of a composition according to the invention comprising 10 wt. % active oxygen component—the composition used for test purposes is stated in the examples part—after storage for 4 weeks in closed PE vessels at 35° C. is expediently more than 50% and preferably more than 60%, particularly preferably about/more than 70%.

The compositions according to the invention can comprise one or more inorganic and/or organic peroxy compounds. The inorganic peroxy compounds are, in particular, such compounds which liberate hydrogen peroxide on dissolving in water. Examples of these are percarbonates, perborates, perphosphates, persulfates and persilicates, preferably alkali metal salts and particularly preferably sodium salts of these substance classes. Sodium percarbonate of the general formula $2Na_2CO_3.3H_2O_2$ is particularly preferred.

According to an alternative embodiment, the composition comprises as the bleaching agent a coated organic peroxy compound, this being, in particular, an aromatic or aliphatic peroxycarboxylic acid which has one, two or more peroxy groups and is solid at room temperature. Peroxy acids having at least 6 carbon atoms, in particular 6 to 18 carbon atoms, are preferred. Examples of aliphatic peroxy acids with one peroxy group are peroxylauric acid, peroxystearic acid and phthalimidoperoxycaproic acid. Aromatic peroxy acids with one or two peroxy groups, such as peroxyphthalic acid, peroxyisophthalic acid, diperoxyphthalic acid and diperoxyisophthalic acid, are also particularly suitable. Among the aliphatic peroxy acids with two peroxy groups, linear diperoxydicarboxylic acids, such as n-hexanediperoxydicarboxylic acid, n-octanediperoxydicarboxylic acid and n-dodecanediperoxydicarboxylic acid, are mentioned by way of example. 2-($C_1$ to $C_{12}$)alkyldiperoxysuccinic acids, such as 2-n-decyldiperoxybutane-1,4-dioic acid, can also be employed. Diacyl peroxides are also active. It is a particular advantage of the invention that the coating according to the invention with a hydrate-forming salt as the innermost layer leads to a very good desensitization of the peroxy compound, so that no undesirable interactions occur between the organic peroxy compound and constituents in the liquid medium which are capable of oxidation. In the case of the more sparingly water-soluble organic peroxycarboxylic acids, the solubility-prolonging second layer can be omitted. The single-layered coating with a hydrate-forming salt is then sufficient.

The amount of coating of the innermost layer is conventionally in the range from 2 to 20 wt. %, based on the coated bleaching agent, but in principle the amount of coating could also be increased if this is desired. In practice, an amount of coating of the innermost layer in the range from 2 to 10 wt. %, in particular 3 to 7 wt. %, is sufficient to ensure an adequate stabilization in combination with one or more outer coating layers. The innermost coating layer can comprise one or more hydrate-forming inorganic salts, these preferably being salts from the series consisting of alkali metal sulfates, magnesium sulfate, alkali metal carbonates, alkali metal bicarbonates, mixed salts of alkali metal bicarbonate and/or alkali metal carbonate, such as sodium sesquicarbonate and [$Na_2SO_4$ $(Na_3CO_3)_n$], alkali metal borates and alkali metal perborates. The innermost layer can additionally also comprise, in addition to one or more hydrate-forming inorganic salts, further compounds having a stabilizing action, such as alkali metal salts of carboxylic acids or hydroxycarboxylic acids. As mentioned above, these salts are particularly preferably sodium salts. The bleaching agent particularly preferably comprises as the innermost coating layer such a one of substantially sodium sulfate. The abovementioned coating amounts are in each case per cent by weight, based on the coated bleaching agent, the coating material having been calculated as hydrate-free.

On the innermost coating layer lie one or more outer coating layers, one of these coating layers comprising alkali metal silicate(s) with a modulus of greater than 2.5, preferably 3 to 5 and particularly preferably 3.2 to 4.2 as the main component (s). The modulus stated for the alkali metal silicate contained as the main component in an outer coating layer is that modulus which the alkali metal silicate solution which was employed for the preparation of the corresponding coating layer had. The term "outer coating layer comprising alkali metal silicate" means either the outermost coating layer of a coating on the sodium percarbonate particles comprising at least two layers or a coating layer which in its turn can be covered by and can cover one or more layers.

Preferred compositions comprise coated sodium percarbonate particles, which can have been produced by any desired preparation process and can comprise stabilizers which are known per se, such as magnesium salts, silicates and phosphates.

In the crystallization process for the preparation of the sodium percarbonate core, hydrogen peroxide and sodium carbonate are reacted in an aqueous phase in the presence or in the absence of a salting out agent to give sodium percarbonate and the latter is separated off from the mother liquor. In the process by fluidized bed spray granulation, an aqueous hydrogen peroxide solution and an aqueous soda solution are sprayed on to sodium percarbonate seeds, which are in a fluidized bed, and at the same time water is evaporated. Finally, sodium percarbonate can also be obtained by bringing solid soda or a hydrate thereof into contact with an aqueous hydrogen peroxide solution and drying.

In respect of a high internal stability of the sodium percarbonate core in the presence of detergent constituents, it is particularly expedient if the average particle diameter is greater than 0.5 mm, and particularly preferably in the range from 0.5 to 1 mm. The particle spectrum expediently contains substantially no particles smaller than 0.2 mm.

The content of particles with a diameter of less than 0.4 mm is preferably less than 10 wt. %, particularly preferably less than 5 wt. %.

The diameter of the sodium percarbonate particles which are coated with at least two layers is only slightly greater than that of the sodium percarbonate core. In general, the thickness of the total coating of the sodium percarbonate core is less than 20 μm. The layer thickness of the layers, of which there are at least two, is preferably in the range from 2 to 15 μm, in particular 4 to 10 μm. Since the amount of the innermost coating layer of the sodium percarbonate particles coated according to the invention as a rule makes up a significantly greater proportion than the outer layer comprising alkali metal silicate, the thickness of the innermost layer is as a rule also greater than that of the outer layer comprising alkali metal silicate.

Although in the description individual layers are referred to, analogously to in the prior art, it should be noted that the constituents of the layers lying on top of one another can pass into one another at least in the boundary region. This at least partial penetration results from the fact that in the case of the particle of the peroxy compound or the particle of the peroxy compound which have a coating layer, the surface is partly superficially dissolved by using an aqueous coating composition solution.

The coating of the inorganic and organic peroxy compounds is carried out in a manner known per se. In principle, the particles to be coated are brought into contact once or several times, as uniformly as possible, with a solution containing one or more coating components, and are dried at the same time or subsequently. For example, the bringing into contact can be effected on a granulating plate or in a mixer, such as a tumble mixer. The coating is particularly preferably carried out by fluidized bed coating, wherein a first solution containing the coating component(s) for formation of an innermost layer and then a second solution containing the coating component(s) for formation of an outer layer are sprayed on to the peroxy compound or peroxy compound coated with one or more layers, which is in a fluidized bed, and are dried at the same time with the fluidized bed gas. The fluidized bed gas can be any desired gas, in particular air, air heated directly with a combustion gas and with a $CO_2$ content in the range from, for example, 0.1 to about 15%, pure $CO_2$, nitrogen and inert gases. Reference is made to the documents acknowledged in the introduction for a detailed description of fluidized bed coating.

According to a particularly preferred embodiment, the innermost coating layer substantially comprises sodium sulfate, which can also be present in part in the hydrated form. The term "substantially" is understood as meaning that sodium bicarbonate or a double salt of sodium bicarbonate, such as sesquicarbonate or Wegscheider salt, can also be contained at least in the boundary layer between the sodium percarbonate core and the innermost layer.

The outer coating layer comprising alkali metal silicates is preferably such a one of sodium silicate which has been obtained by coating a peroxy compound having an innermost coating layer using a sodium water-glass solution with a modulus according to the claims. If the innermost coating layer comprises constituents which have an alkaline action, such as sodium carbonate, the modulus on an alkali metal silicate layer on the innermost coating layer can become somewhat lower and therefore shorten the dissolving time, since interactions between the constituents of the coating layers cannot be ruled out at least in the boundary region. If the coating layer comprising alkali metal silicate is produced by fluidized bed coating, wherein a gas comprising $CO_2$ is used as the fluidized bed gas or driving gas, a lowering of the pH may occur, on the other hand, resulting in an increase in the modulus and therefore an increase in the dissolving time.

In a particularly preferred embodiment of the invention, the composition comprises a peroxy compound coated with at least two layers, wherein the layer comprising alkali metal silicate has been prepared using an aqueous alkali metal silicate solution with a concentration of equal to or less than 20 wt. %, preferably about 5 to 10 wt. %. With a specified amount of alkali metal silicate and a specified modulus in the coating, in fact, the dissolving time can be increased by lowering the use concentration of alkali metal silicate in the solution. It is possible in this manner to obtain, with a considerably lower amount of alkali metal silicate, peroxy compounds which have a sufficiently stable coating and reduce or avoid the known greying problem in a liquid detergent composition. By lowering the alkali metal silicate concentration in the spray solution used for the coating it is possible to lower the amount of alkali metal silicate in the coating to values below 3 wt. %, and preferably to values in the range from 0.5 to 1.5 wt. %. Surprisingly, such products have a high storage stability in water-containing liquid detergents and nevertheless dissolve sufficiently rapidly to be able to liberate the active oxygen at the correct point in time.

Further details of the preparation and composition of the particularly preferred sodium percarbonate particles coated with at least two layers can be found in DE 102 61 161.0, the full content of the disclosure of which is included in this Application.

The liquid detergent, bleaching agent and cleaning agent compositions according to the invention comprise one or more peroxy compounds coated according to the invention in an amount in the range from 1 to 80 wt. %, preferably 2 to 50 wt. %, detergents preferably comprising about 5 to 25 wt. % of coated bleaching agent. The dissolving time of the coating bleaching agent contained in this composition under test conditions at 15° C. is preferably in the range from 15 to 60 minutes. Particularly preferably 15 to 30 minutes.

Compositions according to the invention comprise one or more active components with a surfactant character, in particular in the liquid medium. The amount of such substances employed can be in wide ranges, conventionally in the range from 15 to 70 wt. %, preferably 20 to 60 wt. %. Although the surfactant system can be, in particular, anionic surfactants or nonionic surfactants, preferred compositions comprise both anionic and nonionic surfactants, preferably in the range from 1:2 to 2:1.

The anionic surfactants are, in particular, those from the series consisting of anionic sulfonates, which include sulfonic acids and salts thereof. Examples are $C_5$-$C_{20}$-, preferably $C_{10}$-$C_{16}$-alkylbenzenesulfonates and alkyl ether-sulfonates, primary or secondary $C_6$-$C_{22}$-alkanesulfonates and sulfonated polycarboxylic acids. Alkylbenzenesulfonates, in particular those having 11 to 13 C atoms in the alkyl group, are particularly preferred.

A further class of anionic surfactants comprises primary and secondary alkyl sulfates with a linear or branched alkyl or alkenyl group having 9 to 22 C atoms, in particular 12 to 18 C atoms, and salts thereof. Beta-branched alkyl sulfate surfactants and commercially available mixtures comprising these are particularly preferred. In addition, however, alkyl sulfates which are mono- or polysubstituted by alkyl in the middle of the longest alkyl chain and have, in particular, 14-20 C atoms are also suitable. Examples of these are mono- and dimethyl-branched primary alkyl sulfates having preferably 14 to 16 C atoms in the longest linear chain.

The nonionic surfactants are, in particular, alkoxylated compounds, in particular ethoxylated and propoxylated compounds. Nonionic condensates of alkylphenols with ethylene oxide or propylene oxide, nonionic ethoxylated alcohols and nonionic ethoxylated and/or propoxylated fatty alcohols are particularly suitable. Condensation products of fatty alcohols with 1 to 50 mol, preferably 1 to 10 mol of alkylene oxide are particularly suitable. A further class of nonionic surfactants for compositions according to the invention comprises polyhydroxy-fatty acid amides, wherein an organic radical with one or more hydroxyl groups, which can also be alkoxylated, is bonded to the amide nitrogen. This group is preferably a sugar radical.

The surfactant system in the liquid medium can also comprise a cationic surfactant, in particular in such systems which comprise no anionic surfactant. The cationic surfactants are, for example, mono- and dialkoxylated quaternary amines with a $C_6$- to $C_{18}$-alkyl radical bonded to the nitrogen and one or two hydroxyalkyl groups.

Preferred liquid compositions according to the invention additionally comprise builders dissolved in the liquid medium or suspended therein. The amount of builders employed can be in wide limits, and a content in the range from 2 to 40 wt. % is preferred. Water-soluble builders are, in particular, monomeric carboxylic acids with one or more carboxyl groups, or homo- or copolymers containing carboxyl groups, and salts thereof. The compositions particularly preferably comprise a $C_{12}$ to $C_{18}$-fatty acid or salt thereof. An amount employed in the range from 5 to 20 wt. %, based on the composition, is particularly suitable.

Compositions according to the invention can also comprise builders based on phosphates, such as, in particular, alkali metal tripolyphosphates, and based on alumosilicates, such as, in particular, zeolites and/or crystalline layered silicates. The amount of alumosilicates employed is expediently in the range from 5 to 50 wt. %.

According to a preferred embodiment, the compositions also comprise one or more chelating compounds, in particular those with one or more phosphonate groups, in an amount of up to 15 wt. %, preferably up to 10 wt. %.

The presence of such chelating agents has a favourable effect not only on the washing and cleaning action of the composition, but surprisingly also on the storage stability of a composition comprising alkali metal percarbonate, in particular sodium percarbonate. Particularly suitable phosphonates are alkali metal salts of ethane-1-hydroxy-1,1-diphosphonate, nitrilotrimethylenephosphonate, diethylenetriamine-penta(methylenephosphonate), ethylenediamine-tetra(methylenephosphonate) and hexamethylenediamine-tetra(methylenephosphonate). Further chelating agents are nitrilotriacetic acid and polyaminocarboxylic acids, such as, in particular, ethylenediaminetetraacetic acid, diethylenetriaminepentaacetic acid, ethylenediamine-N,N'-disuccinic acid and alkali metal and ammonium salts thereof. Finally, polybasic carboxylic acids and, in particular, hydroxycarboxylic acids, such as, in particular, tartaric acid and citric acid, are suitable chelating agents for compositions according to the invention.

The liquid medium comprises as the solvent up to 15 wt. % water, preferably 0.5 to 10 wt. % and particularly preferably 3 to 7 wt. %.

As a rule, organic solvents are additionally present as solubilizing agents, and among these, in particular, mono- or polyhydric alcohols having up to 6 C atoms which are liquid at room temperature. The alcohols can additionally contain hydrophilic substituents, such as, in particular, amino, ether and carboxyl groups. Examples of suitable alcohols are: methanol, ethanol, n-propanol, isopropanol, n-butanol, ethylene glycol, 1,3-propylene glycol, 1,3-propylene glycol, 1,4-butylene glycol, glycerol, diethylene glycol, ethylene glycol methyl ether, ethanolamine, diethanolamine and triethanolamine. The organic solvents are expediently present in an amount of less than 30 wt. %, in particular less than 25 wt. %. The concrete amount employed of the one or more organic solvents depends on the solubility of the components contained in the liquid medium, on the effects specifically desired, such as a pH adjustment by alkanolamines, and for adjustment of the viscosity of the liquid medium.

The liquid compositions according to the invention expediently comprise agents for adjustment of the rheological properties, in order on the one hand to impart the desired viscosity to the composition and on the other hand to keep the insoluble constituents dispersed in the composition in the dispersed form. Examples of agents for adjusting the rheological properties are suspension auxiliaries, such as swelling clays, in particular montmorillonites, precipitated and pyrogenic silicas, vegetable gum, in particular xanthans, and polymeric gelling agents, such as vinyl polymers containing carboxyl groups.

The liquid medium can additionally comprise conventional auxiliary substances for detergents and cleaning compositions, and among these fragrances, dyestuffs, optical brighteners, foam inhibitors, disinfectants and agents for regulating the pH. A further class comprises plasticizers based on hydrophilic and organophilic clays.

According to a further preferred embodiment, the compositions comprise one or more so-called activators, which are understood as meaning precursors of peroxycarboxylic acids. Under the washing and cleaning conditions peroxycarboxylic acids, which have both a good bleaching and a disinfecting action, are formed in situ from these activators and the hydrogen peroxide liberated during the dissolving of an inorganic peroxy compound, such as, in particular, sodium percarbonate. Both hydrophobic and hydrophilic activators are used, so that these can be present both dissolved in the liquid medium and/or suspended in this. The activators are, in particular, N- and O-acylated compounds. Nitriles, in particular amino-functionalized nitrites and salts thereof (nitrile-quats), can furthermore be employed as activators. Typical representatives are to be found e.g. in the journal Tenside Surf. Det. 1997, 34(6), pages 404-409.

Suitable classes of activators include anhydrides, esters, imides and oximes. Examples of O-acylated activators are glycerol triacetate, triethyl acetylcitrate, ethylene glycol diacetate, 2,5-diacetoxy-2,5-dihydrofuran and alkanoyloxybenzenesulfonates, such as isomeric trimethylhexanoyloxybenzenesulfonates, sodium nonanoyloxy-benzenesulfonate (NOBS), benzoyloxybenzenesulfonate and nonanoyl-6-aminocaproyloxybenzenesulfonate.

Among the N-acyl compounds there may be mentioned in particular substances with an amide structure and substances with an imide structure, examples are N,N,N',N'-tetraacylated alkylenediamines, such as, in particular, tetraacetylethylenediamine (TAED), N-acyllactams, N-benzoyl-substituted ureas, N-acylsuccinimides and N-acylated imidazoles. In the N-acylated lactams, the lactam ring contains, in particular, 4 to 8 C atoms and the acyl group bonded to the lactam nitrogen 2 to 12, in particular 6 to 12 C atoms. The lactam ring system is, in particular, valerolactam and caprolactam. In activators based on N-acyl-imidazoles and N-acyl-pyrrolidones, benzoyl is a preferred acyl group. Activators of the following general formulae $R^1$—C(O)—$NR^5$—$R^2$—C(O)-L or $R^1$—$NR^5$—C(O)—$R^2$—C(O)-L, the specific meaning of which can be found in EP 0 170 386 A1, can also be employed.

According to a specific embodiment, the composition according to the invention comprises both an inorganic peroxy compound which liberates hydrogen peroxide, in particular sodium percarbonate coated according to the invention, and an activator. Depending on the desired substance properties, the activator can be liquid or solid. Solid activators can be coated or non-coated. Coating of the activator is expedient if this has an inadequate stability in the liquid medium during storage of the composition or, if used in too early a stage, loses its action as a precursor for the formation of a peroxycarboxylic acid, for example by hydrolysis. By application of a single- or multi-stage coating, in particular one such as the peroxy compound has, it is possible to coordinate the dissolving time of the peroxy compound and of the activator to one another. Such a coordination of the dissolving time is of advantage in particular if the system additionally comprises enzymes, which expediently display their full activity before they are deactivated by liberation of the peroxy compound and therefore, in particular, hydrogen peroxide and a peroxycarboxylic acid formed from the activator and hydrogen peroxide.

The composition can additionally comprise conventional washing- and cleaning-active enzymes, in particular lipases, cutinases, amylases, neutral and alkaline proteases, esterases, cellulases, pectinases, lactases and peroxidases.

The liquid detergent and cleaning agent compositions can have both thixotropic, pseudoplastic and shear thinning rheological properties. Thixotropic and pseudoplastic compositions are preferred.

According to a further preferred embodiment of the composition according to the invention, this is packaged in portioned form in bags of a water-soluble polymeric material which are suitable for washing and cleaning purposes. In respect of the material of the bags and in respect of further details of the constituents of the detergent and cleaning composition, reference is made to WO 02/057402 A1, the disclosure content of which is included in the present Application. Compositions according to the invention which are not transparent can comprise an active amount of at least one opacifying agent which is not soluble in the formulation to give a clear solution and thus ensures opacity. Suitable opacifying agents for the purpose mentioned are commercially available products from the series consisting of styrene-acrylate copolymers (e.g. Acusol® Opacifier from Rohm & Haas Co.).

Silicone-quats which contain at least one organic radical with a quaternary ammonium group bonded to Si directly or via an O bridge on a polysiloxane chain, in particular polydimethylsiloxane chain, can also be employed as opacifying agents. The organic radical is, for example, such a one of the general structure -Q-$N^{\oplus}$ $(CH_3)_2$—R; Q represents a bridge member having 2 to 6 C atoms, which can also contain one or more substituents, such as OH, and R represents alkyl having 1 to 18, in particular 1 to 3 C atoms, wherein R represents alkyl which can be substituted internally or terminally, for example by OH, Cl, $NH_2$, COOH, $OCH_3$ or ($C_2$-$C_{18}$)acyl-NH. Silicone-quats are commercially obtainable (Rewoquat®SQ from Degussa AG).

An amount employed in the range from 0.1 to 3 wt. %, in particular 0.5 to 2 wt. %, is sufficient already to obtain a composition which is completely opaque in a thin layer (approx. 5-10 mm).

The invention is illustrated further with the aid of the following examples. The experiments show the unexpected effect of the increase in stability with a simultaneously appropriate dissolving time of the inorganic bleaching components in a detergent composition.

EXAMPLES a) Preparation of Coated Bleaching Agent

Sodium percarbonate coated with two layers was prepared by coating sodium percarbonate in a fluidized bed, the first layer substantially comprising sodium sulfate and the second layer comprising substantially sodium silicates. Details of the preparation and variation are to be found in DE 102 61 161.0.

In the examples, a commercially available sodium percarbonate coated with 6 wt. % sodium sulfate was employed as the starting material, namely Q30 and Q35 from Degussa, which differ only in the grain spectrum, Q35 being coarser than Q30 (Q30: $D_{50}$=0.55 mm, Q35: $D_{50}$=0.70 mm)

Q30 or Q35 was coated in a fluidized bed coating unit using a water-glass solution. Spraying was carried out at a fluidized bed temperature of about 60° C. Air served as the fluidized bed gas at an intake temperature in the region of about 100° C. After the spraying the feed air temperature was lowered somewhat and after-drying was carried out at a fluidized bed temperature of 85° C. The concentration of the water-glass solution, the modulus, the coating amount and the dissolving time in water, measured at 2 g/l, at 15° C. by conductometric monitoring at up to 95% dissolution, follow from table 2.

TABLE 1

| Base recipe (1,000 g batch) | |
|---|---|
| Amount (g) | Constituents |
| 97.4 | Monoethanolamine |
| 40.0 | Water |
| 36.6 | Ethanol |
| 161.4 | Phenoxyethanol |
| 235.6 | $C_{13}$–$C_{15}$-Fatty alcohol polyglycol ether (4EO) |
| 258.0 | Dodecylbenzenesulfonate |
| 172.0 | Coconut fatty acid |

The water content of the recipe was determined as 4.9 wt. % by mean of Karl Fischer titration.

TABLE 2

Storage stability of sodium percarbonate coated with two layers in a liquid detergent

| Ex. No. | Coating 1st layer: $Na_2SO_4$ 2nd layer: as stated **) | Dissolving time (min) | % Oa after storage at 35° C. after x weeks (w) Start | 2 w | 4 w | Residual Oa after 4 w without stabilizer (% rel) | Residual Oa after 4 w with EDTMP stabilizer (% rel) |
|---|---|---|---|---|---|---|---|
| CE1 | Q30 *) | 1.5 | 13.58 | 7.20 | 3.77 | 28 | 55 |
| E1 | Q30/2% Wg 2.0 | 10 | 13.51 | 7.32 | 4.30 | 32 | |
| E2 | Q30/1% Wg 3.2 | 12 | 13.48 | 10.53 | 8.23 | 61 | |
| E3 | Q30/3% Wg 3.2 | 59 | 13.21 | 12.00 | 11.26 | 85 | 89 |
| E4 | Q30/5% Wg 3.2 | 71 | 13.28 | 11.98 | 11.20 | 84 | |
| E5 ***) | Q35/0.75% Wg 3.2 | | 13.46 | 10.38 | 8.46 | 63 | 67 |
| E6 ***) | Q35/0.75% Wg 3.2 | 12.7 | 13.29 | 11.55 | 9.95 | 75 | |
| E7 | Q35/1.5% Wg 3.3 | 35 | 12.95 | 11.96 | 11.26 | 87 | |
| E8 | Q35/1.5% Wg 4.0 | 60 | 13.24 | 11.92 | 11.24 | 85 | |
| E9 | Q35/0.75% Wg 3.4# | 14.8 | 13.34 | 11.73 | 10.67 | 80 | |
| E10 | Q35/0.75% Wg 3.4# | 19.6 | 13.33 | 12.10 | 11.29 | 85 | |
| E11 | Q30/0.75% Wg 3.2## | 8.3 | 13.50 | 12.14 | 11.29 | 84 | |
| E12 | Q30/1.5% Wg 3.2## | 36 | 13.35 | 12.62 | 12.16 | 91 | |

*) Q30 = Sodium percarbonate with 6% $Na_2SO_4$ in a single coating layer Q35 = as Q30, but coarser grain spectrum

**) 2nd layer is sodium silicate (water-glass = Wg) with the modulus stated; coating amount in wt. %. The 2nd layer was prepared using sodium water-glass with a concentration of 10 wt. % (examples E1 to E8)

***) In E5 and E6 the same starting substance and the same water solution were employed, but the coating was carried out on the laboratory scale in E6 and in a pilot plant in E5. The smooth surface of E6 compared with E5, detectable by means of SEM photographs, is probably responsible for the increased stability of E6.

#) The coating layer of water-glass was prepared in E9 as in examples E1 to E8 using a 10 wt. % water-glass solution; the layer of E10 was prepared using a 5 wt. % water-glass solution with the same modulus (Wg 3.4).

) Before application of the coating layers, the fines content with <0.4 mm grain size was separated off by sieving.

b) Determination of the Stability

The sodium percarbonate coated with two layers was added in an amount of 10 wt. % to a liquid base recipe comprising washing- and cleaning-active components, the mixture was mixed homogeneously and the liquid mixture was stored at 35° C. in PE drums for up to 4 weeks. To determine the active oxygen, the total contents of each drum were dissolved completely and the Oa content was determined iodometrically. The Oa contents at the start and after 2 and 4 weeks and the residual Oa contents (relative to the starting Oa) follow from the table.

In further experiments, a phosphate stabilizer was additionally added to the composition—0.5% ethylenediaminetetramethylenephosphonate (EDTMP). It was possible to increase the storage stability further by means of the stabilizer.

c) Determination of the Bleaching Activity

To determine the bleaching activity, standardized cotton test fabric with staining by tea (WFK CFT PC/BC1) and red wine (EMPA 114) together with 3 kg of laundry were washed in a commercially available drum machine at a washing temperature of 30° C. A mixture of 50 g base recipe from table 1, 11.25 g sodium percarbonate and 4.14 g TAED was employed as the liquid detergent. The bleaching action was determined by determining the increase in reflectance of the washed test fabric at 457 nm. (xenon lamp, UV barrier filter 420 nm, ceramic white standard from Datacolor) as the mean from 5 washing experiments. The results of the washing experiments are summarized in table 3. The experiment numbers of the detergent compositions according to the invention correspond to the experiment numbers in table 2.

TABLE 3

| Bleaching action of liquid detergents comprising sodium percarbonate | | | |
|---|---|---|---|
| Ex. No. | Sodium percarbonate | % increase in reflectance tea stains | % increase in reflectance red wine stains |
| CE2 | Q35 | 8.5 | 21.8 |
| E7 | Q35/1.5% Wg 3.3 | 5.7 | 19.5 |
| E9 | Q35/0.75% Wg 3.4 | 6.8 | 20.3 |
| E10 | Q35/0.75% Wg 3.4 | 6.3 | 20.4 |
| CE3 | none | 0.8 | 12.3 |

What is claimed is:

1. A liquid detergent and cleaning agent composition comprising a liquid medium with a water content of up to 15 wt %, based on the composition, and particles of bleaching agent suspended in said liquid medium, wherein each particle has a coating surrounding said bleaching agent, said coating being comprised of at least two layers:

a) an innermost layer, comprising one or more hydrate-forming inorganic salts as the main component(s), and wherein said innermost layer makes up 2 to 20 wt % of the particle of coated bleaching agent; and b) an outer layer, which comprises as its main component (s), alkali metal silicate(s) with a modulus of $SiO_2$ to $M_2O$ (M=alkali metal) of greater than 2.5, and wherein said outer layer makes up 0.2 to 5 wt % of the particle of coated bleaching agent, and wherein the dissolving time of said particles of bleaching agent is at least 5 minutes, as measured for 95% dissolution in water at 15° C. and 2 g/l.

2. The composition of claim 1, wherein said bleaching agent is an inorganic or organic peroxy compounds.

3. The composition of claim 1, wherein said bleaching agent comprises sodium percarbonate.

4. The composition of claim 1, wherein said bleaching agent comprises a peroxycarboxylic acid with one or two peroxy groups.

5. The composition of claim 1, wherein the innermost layer of said coating consists essentially of one or more salts selected from the group consisting of: alkali metal sulfates; magnesium sulfate; alkali metal carbonates; alkali metal bicarbonates; mixed salts of sodium carbonate with sodium bicarbonates or with sodium sulfate; alkali metal borates; and alkali metal perborates.

6. The composition of claim 1, wherein the outer layer of said coating consists essentially of 0.2 to less than 3.0 wt % alkali metal silicate with a modulus in the range of from 3 to 5.

7. The composition of claim 1, wherein the outer layer of said coating is prepared using an aqueous solution with an alkali metal silicate content of 20 wt % or less.

8. The composition of claim 1, wherein said composition comprises 2 to 50 wt % of said particles of bleaching agent and wherein the dissolving time of said particles of bleaching agent is in the range of from 10 to 60 minutes.

9. The composition of claim 1, wherein said bleaching agent is a coated inorganic peroxy salt and said composition further comprises an active amount of a bleaching activator.

10. The composition of claim 9, wherein said bleaching activator has a coating of one or more layers which reduces the rate of solution.

11. The composition of claim 1, wherein said liquid medium comprises: one or more anionic and/or nonionic surfactants; water; a mono- or polyhydric alcohol having up to 6 C atoms and which can optionally contain further hydrophilic substituents; and, optionally, a stabilizer which is capable of forming a chelate complex.

12. The composition of claim 1, further comprising one or more washing- and/or cleaning-active enzymes.

13. The composition of claim 1, wherein said composition is packaged in portioned form in bags of a water-soluble polymeric material which are suitable for washing and cleaning purposes.

14. The composition of claim 1, further comprising an active amount of an opacifying agent selected from either styrene-acrylic copolymers or silicone-quats.

15. The composition of claim 1, wherein said composition comprises sodium percarbonate with an average particle diameter in the range of from 0.5 to 1 mm and substantially no particles of bleaching agent smaller than 0.2 mm.

16. The composition of claim 1, wherein said particles of bleaching agent comprise sodium percarbonate and wherein the content of particles with a diameter of less than 0.4 mm is less than 10 wt % of said bleaching agent.

* * * * *